United States Patent [19]

Stalberger, Jr. et al.

[11] 3,937,470

[45] Feb. 10, 1976

[54] GAME FOOTBAG

[75] Inventors: Robert John Stalberger, Jr.; Michael David Marshall, both of Oregon City, Oreg.

[73] Assignees: Robert John Stalberger, Jr., Milwaukie; Michael David Marshall, Oregon City, both of Oreg.; Clark Schneider, Houston, Tex. ; part interest to each

[22] Filed: Dec. 4, 1974

[21] Appl. No.: 529,451

[52] U.S. Cl. ..... 273/106 R

[51] Int. Cl.[2] ..... A63B 67/00

[58] Field of Search ..... 273/106 R, 106 A

[56] References Cited

UNITED STATES PATENTS 3,091,460 5/1963 Maldonado ..... 273/106 R X 3,480,280 11/1969 Gamertsfelder ..... 273/106 R

FOREIGN PATENTS OR APPLICATIONS 1,578,301 7/1969 France ..... 273/106 A

*Primary Examiner*—Paul E. Shapiro

*Attorney, Agent, or Firm*—Klarquist, Sparkman, Campbell, Leigh, Hall & Whinston

[57] ABSTRACT

A game footbag has a tough, flexible cover partly filled with predominantly parallel small discs to form a thick disc or flattened sphere to be kicked vertically repeatedly to keep it in the air as long as possible.

10 Claims, 2 Drawing Figures

GAME FOOTBAG

Figure 2:
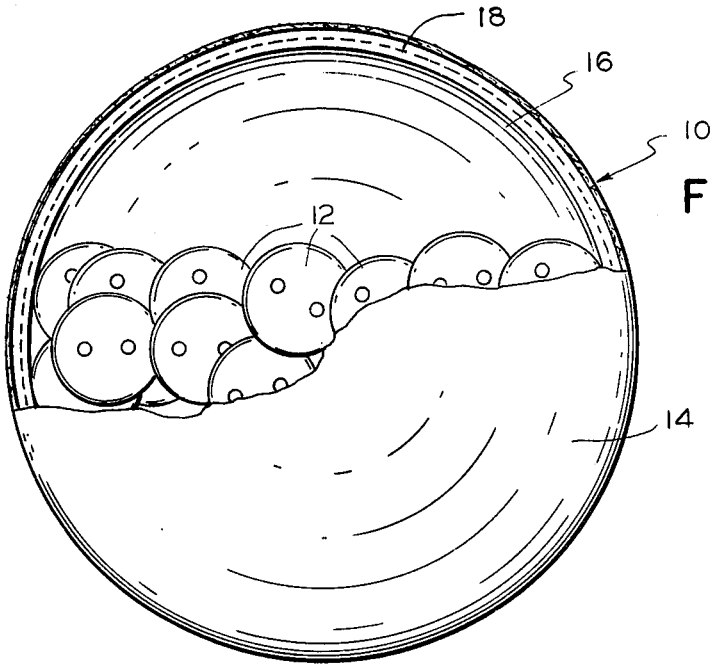

This invention relates to a game footbag, and has for an object thereof the provision of a tough, durable, slow action footbag.

Another object of the invention is to provide a durable, easily deformed footbag that can be kicked substantially vertically much more easily than a ball.

A further object of the invention is to provide a loosely packed, easily deformed bag adapted to be kicked.

Another object of the invention is to provide a flattened spherical ball having a tough, flexible outer cover and filling elements at least to a large extent of discs predominantly parallel to each other.

Figure 1:
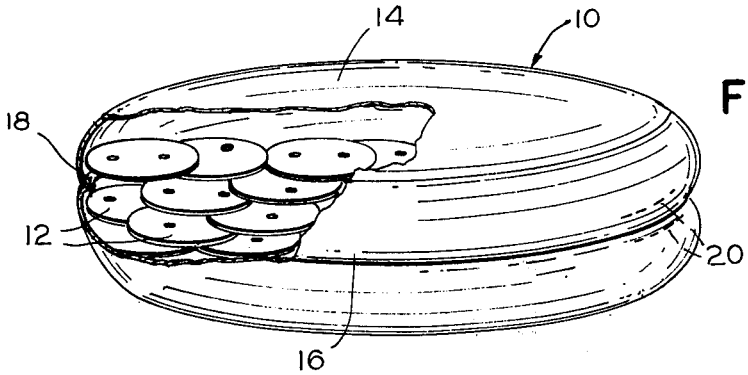

In the drawings:

FIG. 1 is a partially sectional, perspective view of a game footbag forming one embodiment of the invention; and, FIG. 2 is a partially sectional top plan view of the game footbag of FIG. 1.

Referring now in detail to the drawings, there is shown therein a game footbag forming a specific embodiment of the invention and which is to be used in games in which the object is to keep the footbag in the air by kicking it substantially vertically whenever it nears the ground. As a practical matter, this requires the footbag to be substantially non-resilient and readily deformable or partially collapsible so that it is not too fast and so that good control as to direction is provided.

The footbag includes a tough, easily deformed, flexible cover or bag 10 and filling discs 12 comprising small, tough non-brittle discs partially filling the bag, preferably to about two-thirds full. The footbag has the shape of a flattened sphere or thick disc with a rounded periphery, being somewhat like a common, double-sided powder puff in shape.

The cover is preferably quite thin, elkhide or split leather, and is made up of two discs 14 and 16 having inside stitching 18 except for a short section of outside stitching 20 made last to enable the bag to be turned right side out and filled after the inside stitching has been made. If desired, in place of the outside stitching a short, lightweight zipper may be used, or inside stitching may be substituted for the outside stitching and a slit provided in the central portion of one of the discs to permit the bag to be turned right side out and filled, the slit then being closed by stitching, a lightweight zipper or other closure means.

The filler discs 12 tend to stack and lie parallel to each other and parallel to the substantially flat sides of the cover. The discs 12 slide easily so that the bag can easily, partially collapse edgewise when given a somewhat edgewise kick. This enables the kicker to kick the bag substantially in the direction that he moves his foot regardless of whether the kicking foot engages the bag partially edgewise during the kick. Commonly available plastic buttons preferably all or at least predominantly of the same size work excellently as the filler discs 12. For a diameter of the bag of two inches, the diameters of the small discs should be from about one-quarter inch to one-half inch, this bag preferably weighing from about 1 to 1½ ounces, and being about three-quarters of an inch in thickness. For a bag of a diameter of 5 inches, the filler discs should have diameters of from about one-quarter inch to about three-quarters of an inch, the thickness of the bag being about 1⅜ inches and the weight preferably being from 2½ to 3¾ ounces.

What is claimed is:

1. In a partially collapsible footbag, a hollow, flexible cover normally in the general shape of a flattened sphere of a predetermined diameter, and filler material at least primarily of a multitude of hard, smooth, small discs of a diameter or diameters no greater than a small fraction of the diameter of the flattened sphere and lying generally parallel to each other and parallel to the flat sides of the cover, the discs being slidable relative to each other and the cover and only partially filling the cover.

2. The footbag of claim 1 wherein the filler material fills the bag about two-thirds of its capacity.

3. The footbag of claim 2 wherein the small discs are predominantly of the same size and have a diameter a small fraction of the diameter of the cover.

4. The footbag of claim 3 wherein the cover is of a flexible leather or leatherlike material.

5. The footbag of claim 4 wherein the cover comprises two discs stitched together along an inside seam.

6. The footbag of claim 4 wherein the diameter of the small discs is from about one-eighth to about one-quarter of the diameter of the cover.

7. The footbag of claim 1 wherein the small discs are of plastic material.

8. The footbag of claim 7 wherein the small discs are tough plastic buttons.

9. The footbag of claim 8 wherein the buttons fill the cover to about two-thirds of its volume.

10. The footbag of claim 7 wherein the small discs fill the cover to about two-thirds of its volume.

* * * * *